United States Patent [19]

Feurstein

[11] 4,069,594

[45] Jan. 24, 1978

[54] DRYING CYLINDER

[75] Inventor: Guntram Feurstein, Weingarten, Germany

[73] Assignee: Sulzer Brothers Limited, Winterthur, Switzerland

[21] Appl. No.: 710,310

[22] Filed: July 30, 1976

[30] Foreign Application Priority Data

Aug. 6, 1975 Switzerland ..... 10237/75

[51] Int. Cl.[2] ..... F26B 11/02

[52] U.S. Cl. ..... 34/124; 165/90

[58] Field of Search ..... 432/60, 228; 165/89, 165/90; 219/469; 34/119–122, 124, 125

[56] References Cited

U.S. PATENT DOCUMENTS

| | | | |
|---|---|---|---|
| 3,473,238 | 10/1969 | Talley, Jr. et al. | 165/90 |
| 3,481,050 | 12/1969 | Cox, Jr. | 34/124 |
| 3,553,849 | 1/1971 | Carrier et al. | 34/124 |
| 3,724,094 | 4/1973 | Appel et al. | 34/124 |
| 3,802,093 | 4/1974 | Ebeling | 34/124 |
| 3,914,875 | 10/1975 | Schiel | 34/124 |

*Primary Examiner*—John J. Camby
*Assistant Examiner*—Henry C. Yuen
*Attorney, Agent, or Firm*—Kenyon & Kenyon, Reilly, Carr & Chapin

[57] ABSTRACT

The grooves of the drying cylinder are provided with turbulence producers in the form of U-shaped inserts, split rings, perforated strips or bands, and lattice-like wire strips in order to create turbulence in the otherwise laminar flow of condensate. This turbulence eliminates the heat insulating effect of the condensate. The turbulence producers are spaced from the base of a groove by at least 0.5 millimeters while the maximum spacing of the internal surface of the producers from the groove base is 10 millimeters.

12 Claims, 13 Drawing Figures

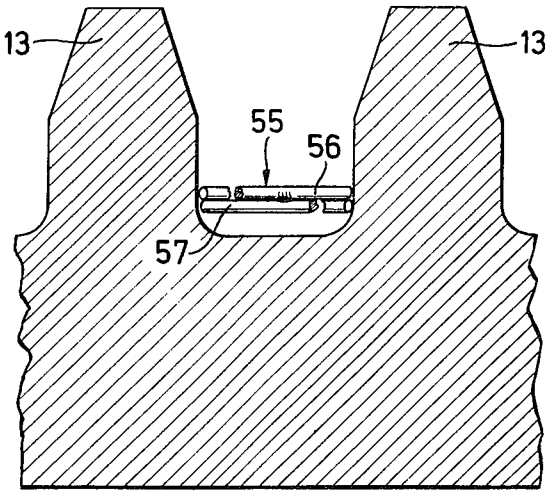
Fig. 10
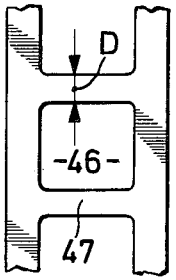
Fig. 11
Fig. 12
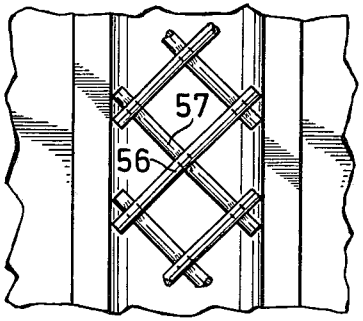
Fig. 13

DRYING CYLINDER

This invention relates to a drying cylinder and, in particular, to a drying cylinder for a paper making machine.

As is known, the drying cylinders of paper making machines are usually steam heated from within and are provided with various means to remove the condensate formed by the steam during heat transfer. In many cases, the drying cylinders are provided with internal grooves to collect the condensate and discharge tubes which extend into the grooves to draw off the condensate. Usually, these tubes are secured within the drying cylinder to rotate with the drying cylinder.

Drying cylinders of the above kind are known, e.g. from German Pat. Specification No. 497,034 wherein the condensate which is formed in the cylinder is hurled away into the grooves by ribs. In this way, the ribs are free of a condensate layer which would have an insulating effect. The condensate which has collected in the grooves is then removed from the cylinder as a result of the steam pressure operative therein. In operation, the condensate in the grooves flow to two or more discharge pipes which are disposed in each groove at the periphery; the condensate experiencing both centrifugal force and gravity. Centrifugal force alone would lead to the formation of a layer of condensate of uniform height in the discrete grooves, whereas gravity produces a rise in the level of the condensate in the grooves in the top region of the cylinder, the highest-level zone being displaced from the highest position in the cylinder in the direction of rotation thereof because of friction. Consequently, gravity produces flows of condensate in the cylinder which are superimposed upon the flow to the discharge tubes. In an ordinary drying cylinder of this kind, such flows are substantially laminar. Thus, heat exchange between the condensate and the groove walls is relatively poor.

A suggestion to improve the heat exchange in ungrooved drying cylinders having a smooth inside wall, according to German Offenlegungsschrift No. 2,257,799, is for gravity in combination with longitudinal ledges to produce a reciprocating motion of the condensate, resonance occurring in some circumstances. The resulting increases in the rates of flow are alleged to improve the heat exchange between the condensate and the cylinder wall. In furtherance of this concept, German Offenlegungsschrift No. 2,338,992 proposes the provision of blocking elements in the peripheral grooves of a grooved drying cylinder to block the groove cross-section at least in the region near the groove base.

However, these concepts require complex constructions and in many instances do not achieve efficient heat exchange.

Accordingly, it is an object of this invention to improve the heat exchange effect of drying cylinders.

It is another object of the invention to use a simple means to increase the heat exchange effect of a drying cylinder.

It is another object of the invention to improve the heat exchange between the condensate and the generated surface of a drying cylinder in the peripheral grooves of a grooved cylinder.

Briefly, the invention provides a drying cylinder which comprises a cylinder having an internal cylindrical wall and a plurality of grooves in the wall with a plurality of turbulence producers in the grooves. Each of the turbulence producers has at least one transverse part which extends transversely of the peripheral direction of the grooves and which is in spaced relation to the base of the associated groove to define a gap between the boundary of the transverse part and the lowest part of the groove.

Since the condensate can flow through the gaps between the turbulence producers and the grooves as well as over the turbulence producers, turbulence is effected over the complete cross-section of the condensate flow. Indeed, in contrast to the suggestion made in German Offenlegungsschrift No. 2,338,922, the heat exchange between the transverse parts of the turbulence producers and the groove bases is better than in the other places since the rate of flow through the gaps defined by the transverse parts is higher than elsewhere. Another result of turbulence throughout the condensate flow cross-section is that heat exchange from the condensing steam to the groove base is by way of eddying. Thus, differences in condensate level around the cylinder periphery have less effect than previously. Also, the considerably increased turbulence of the condensate improves heat exchange considerably as compared with the prior art.

The gap between the extended surface of the transverse part and the deepest part of the groove can be at least 0.5 millimeter. This ensures that the condensate flow cross- section remains satisfactory over the transverse part.

Also, the maximum distance between the internal surface of the transverse part and the deepest part of the groove can be 10 millimeters, since the transverse parts have an optimal turbulence effect when they are completely immersed in the condensate.

Preferably, the transverse part has a cross-sectional shape in the cross-section peripendicular to its longitudinal axis, whose major dimension is at most three times its minor dimension. This cross-sectional shape is very advantageous for producing turbulence.

In one particular embodiment, the transverse part can be of circular cross-section. Transverse parts of this kind can be produced from wire very simply and cheaply. However, the transverse parts can of course be e.g. of rectangular cross-section.

Since the turbulence producers serve only to produce turbulence in the condensate flow and are not required to produce resonance effects, the peripheral spacing between the transverse parts is not critical. For optimum effects, the spacing between adjacent transverse parts can be from (5) to (100) times their height relative to the base of a groove radially of the cylinder.

The turbulence producers can be U-shaped or annular inserts which are clamped in the grooves. Preferably, however, the turbulence producers are in the shape of strips which are introduced in the grooves and which have transverse parts disposed at an equidistant spacing. Turbulence producers of this kind are simple to manufacture and assemble and very effective.

In another embodiment, the turbulence producers are made of wire and comprise at least one wire which extends lengthwise of a cylinder groove and a plurality of wire pieces which are secured to the wire to form the transverse parts. Turbulence producers of this kind are very simple and can be secured in a simple manner in the grooves by pressing in or clamping in the wire strip. Also, the turbulence producers can be perforated strips or bands or the like which are perforated as with punched orifices.

In another embodiment, the turbulence producers are strips of wire pieces arranged lattice-fashion with the wire pieces extending at an angle to the peripheral direction of the groove. In this embodiment, which has the advantages of the embodiments hereinbefore outlined, there is an additional movement of condensate flow, in a manner which may sometimes be required, transversely of groove length due to the inclination of the wire pieces.

These and other objects and advantages of the invention will become more apparent from the following detailed description and appended claims taken in conjunction with the accompanying drawings in which:

FIG. 10 illustrates a perforated strip type turbulence producer according to the invention;

FIG. 11 illustrates a plan view of the perforated strip type turbulence producer of FIG. 10;

FIG. 12 illustrates a lattice-type turbulence producer according to the invention; and FIG. 13 illustrates a plan view of the lattice-type turbulence producer of FIG. 12.

Figure 1:
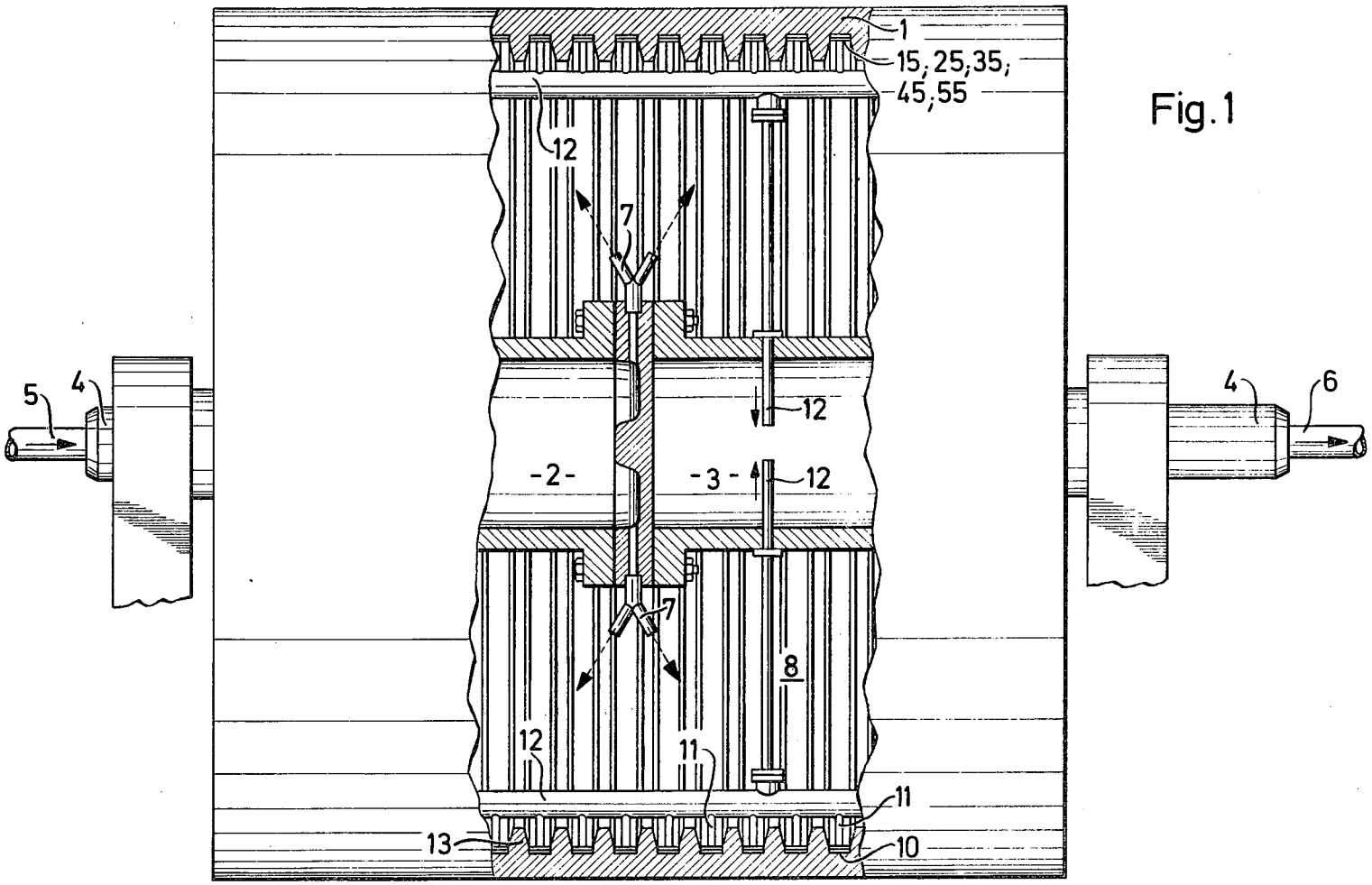
FIG. 1 illustrates a diagrammatic and partly sectioned view of a drying cylinder according to the invention for a paper making machine.

Referring to FIG. 1, a drying cylinder, for example for a paper making machine, has a rotatable cylinder 1 which is constructed with an internal chamber 2 to receive a supply of heating steam and a chamber 3 for the discharge of condensate. These chambers 2, 3 connect, via a spigot 4, respectively to a steam line 5 and a condensate line 6. In addition, pipes 7 are connected to the steam chamber 2 to pass delivered steam into an inner chamber 8 of the cylinder 1.

The cylinder 1 has an internal cylindrical wall or envelope in which annular grooves 10 are formed by a plurality of annular ribs or fins 13 which project radially inwardly of the cylinder 1. The steam which enters the inner chamber 8 via the pipes 7 condenses in known manner on the cylinder inner wall which is cooled by the material (not shown) being dried. The condensate then accumulates in the grooves 10.

Figure 2:
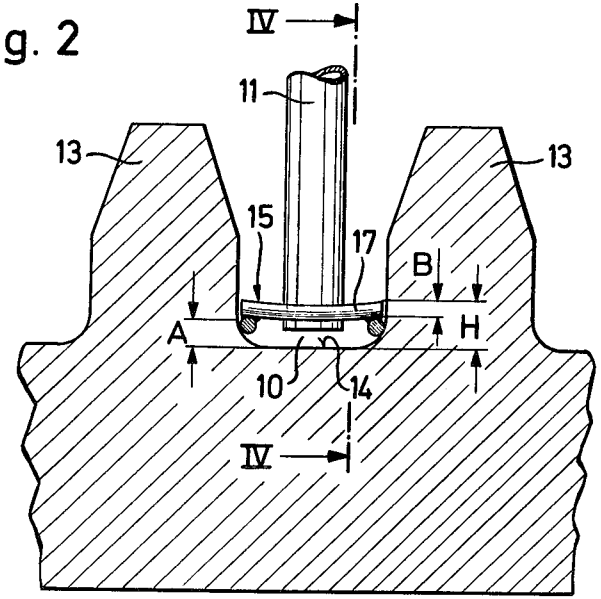
FIG. 2 illustrates a partly sectioned view taken from FIG. 1, to an enlarged scale, of a groove in which a turbulence producer is disposed in accordance with the invention.

In order to remove the condensate from the grooves 10, a plurality of discharge tubes 11 are secured to a header 12 in the cylinder 1 and extend into communication with a respective groove to a point near the base 14 of the groove (FIG. 2). During operation, the condensate together with some of the steam passes from the tubes 11 into the headers 12 and therefrom to the condensate chamber 3 for removal through the condensate line 6.

Figure 3:
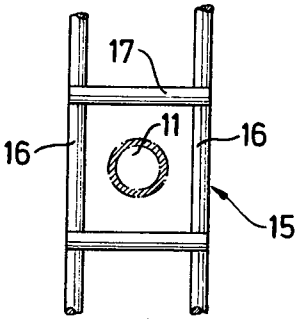
FIG. 3 illustrates a plan view of a portion of the turbulence producer shown in FIG. 2.

Referring to FIGS. 2 and 3, a turbulence producer 15 is disposed in each groove 10. As shown, the turbulence producer 15 is in the form of a strip embodided by two wires 16 which extend peripherally of the groove 10 and by transverse parts 17 which are secured to the wires 16. The transverse parts 17 are embodied by pieces of wire and, in the present case, have the same diameter D as the wires 16.

Figure 4:
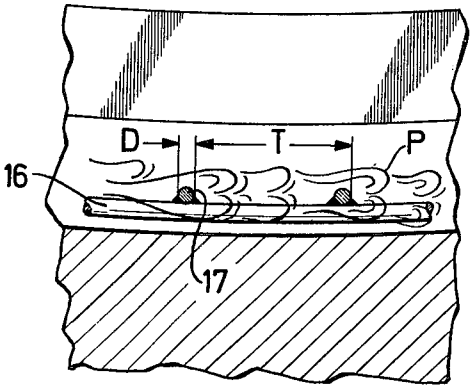
FIG. 4 illustrates a partly sectioned view on the line IV—IV of FIG. 2.

Referring to FIG. 4, during operation of the drying cylinder, condensate flows from the discrete grooves 10 at the periphery of the cylinder 1 to the discharge pipes 11. Because of gravity, there is a simultaneous condensate flow motion which, in relation to cylinder 1, is reciprocating. The condensate in the grooves 10 is therefore eddied as indicated by arrows P. The eddying improves heat exchange between the condensate and the cylinder wall, particularly the base 14 of the groove 10 as well as the heat exchange between the steam chamber 8 and the base 14 of the groove 10. Because of the intensive heat transmission radially of the cylinder 1, the thickness of the condensate layer ceases to be of great importance.

For the required effect to occur, a gap A of at least 0.5 millimeters (mm) must be left between the external surface (i.e. bottom boundary as viewed) of the transverse part 17 and the deepest place of the groove 10 — the base 14 in the present case. The presence of the gap A insures that, as can be seen in FIG. 4, there can be an adequate flow of condensate between the transverse parts 17 and the groove base 14 and that stagnant water zones cannot form near the turbulence producers 15.

The maximum distance H between the internal surface (i.e. the top boundary as viewed) of the transverse part 17 and the deepest place of the groove 10 should be at most 10 millimeters (mm) to ensure that the transverse parts are immersed in the condensate during operation to an extent sufficient for the condensate to flow over (i.e. over as viewed) the transverse parts 17.

Since the turbulence producers are simply elements for producing turbulence and, in contrast to the known devices described above, have nothing to do with producing resonance, the spacing between the transverse parts 17 is not critical. However, of course, an excessive spacing T between the discrete transverse parts of the turbulence producers in FIG. 4 reduces effectiveness. If the parts 17 are too close together, the increase in effectiveness of the turbulence producer is insignificant and incommensurate with cost. The optimum spacing between adjacent transverse parts 17 has been found to be from 5 to 100 times the height H of the transverse parts 17 relative to the groove base 14 perpendicularly to the peripheral direction of the cylinder 1.

As shown in FIGS. 1 to 4, the transverse parts 17 are made of circular wires, and so the dimension D in the peripheral direction of the cylinder 1 is equal to the diameter of the wire. Conceivably, however, the dimensions of the transverse part 17 peripherally of the cylinder 1 and radially thereof (dimension B in FIG. 2) may differ. Preferably, however, the major (i.e. peripheral) of a transverse part is at most 3 times its minor (i.e. radial) dimension.

Figure 5:
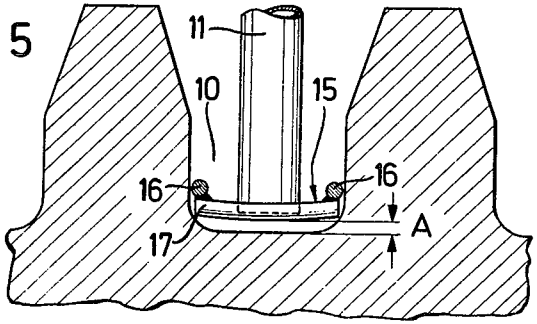
FIG. 5 illustrates a partly sectional view corresponding to FIG. 2 of another embodiment of the turbulence producer.

Referring to FIG. 5, wherein like reference characters indicate like parts as above, the turbulence producers 15 may alternatively be placed in a groove 10 the opposite way round. In this case, the transverse parts 17 are disposed outside the wires 16 and so the gap A can be smaller than in the arrangement shown in FIG. 2 although no less than 0.5 millimeters.

In order to mount a turbulence producer 15 in place, the turbulence producer 15 is laid down in a groove 10 and pressed into a clamped relation with the ribs 13.

Figure 6:
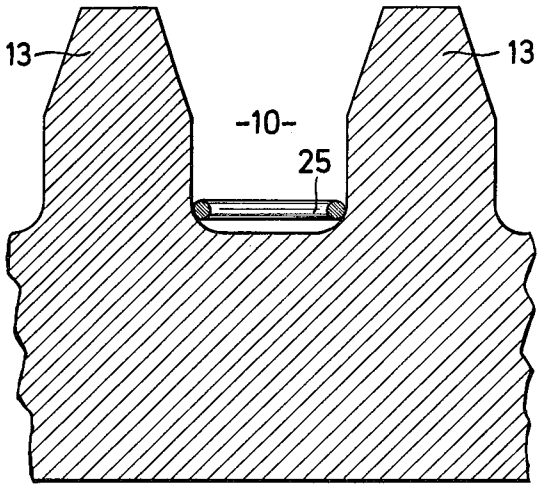
FIG. 6 illustrates a turbulence producer of annular type in a groove according to the invention.
Figure 7:
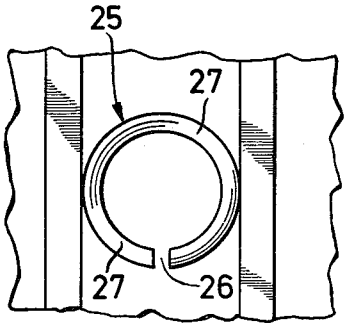
FIG. 7 illustrates a plan view of the annular turbulence producer of FIG. 6.

Referring to FIGS. 6 and 7, the turbulence producers may alternatively be in the form of annular inserts, e.g. resilient split rings 25 each of which is clamped in a groove 10 of the drying cylinder and which is provided with a gap 26. In other respects, the turbulence producer 25 operates in the same way as the turbulence producer 15; the parts 27 which extend transversely to the periphery of the groove 10 are the transverse parts. The turbulence producers 25 are placed in the groove 10 at appropriate spacings from one another.

Figure 8:
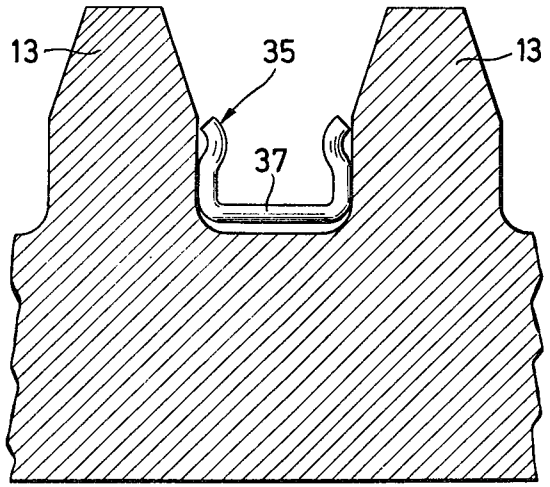
FIG. 8 illustrates a U-shaped type turbulence producer according to the invention.
Figure 9:
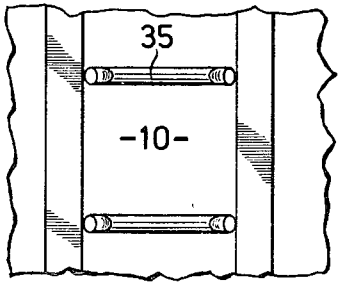
FIG. 9 illustrates a plan view of the U-shaped type turbulence producer of FIG. 8.

Referring to FIGS. 8 and 9, turbulence producers 35 may also be in the form of U-shaped inserts which are also secured in the grooves 10 at appropriate spacings. In this embodiment, the horizontal arms 37 of the inserts 35 are the transverse parts.

Referring to FIGS. 10 and 11, the turbulence producer 45 may also be in the form of a strip as the turbulence producer 15 of FIGS. 2 – 4. However, this turbulence producer 45 is made from a perforated metal strip in which apertures 46 are punched. Webs 47 are left between the apertures 46 to form the transverse parts. The cross-sectional dimensions B, D of the webs 47 differ from one another as previously described with reference to FIGS. 2 to 4, i.e. at ratio of B:D of no more than 1:3.

Referring to FIGS. 12 and 13, the turbulence producer 55 may also be of a strip-type which is made lattice- fashion of wire pieces 56, 57. As shown in FIG. 13, the wire pieces 56, 57 are inclined at an angle to the periphery of the groove 10. The pieces 56, 57 of the turbulence producer 55 form the transverse parts and produce, in addition to the turbulent flow peripherally of the groove 10 as shown in FIG. 4, turbulence in the direction perpendicular to the plane of the illustration in FIG. 4. The latter turbulence may in some circumstances further improve heat transmission by the condensate layer in the groove 10.

What is claimed is:

1. A drying cylinder for a paper making machine comprising a rotatable cylinder having an internal wall;

a plurality of peripheral grooves formed in said wall, each said groove having a base;

a plurality of discharge tubes secured in said cylinder for rotation therewith, each said tube communicating with a respective one of said grooves to remove condensate therefrom; and a plurality of turbulence producers disposed in said grooves, each said turbulence producer having at least one transverse part extending transversely of a respective groove in spaced relation to said base of said respective groove to define a gap therebetween.

2. A drying cylinder as set forth in claim 1 wherein said gap is at least 0.5 millimeters.

3. A drying cylinder as set forth in claim 1 wherein each said turbulence producer has an internal surface spaced from said groove base a distance at most of 10 millimeters.

4. A drying cylinder as set forth in claim 1 wherein each said transverse part of a turbulence producer has a cross-sectional shape with a major peripheral dimension at most three times the radial dimension thereof.

5. A drying cylinder as set forth in claim 4 wherein the cross-sectional shape is circular.

6. A drying cylinder as set forth in claim 4 wherein said transverse parts are spaced apart a distance from 5 to 100 times the height of one of said transverse parts relative to the base of one of said grooves.

7. A drying cylinder as set forth in claim 1 wherein said turbulence producers are U-shaped inserts clamped in a respective groove.

8. A drying cylinder as set forth in claim 1 wherein said turbulence producers are annular inserts clamped in a respective groove.

9. A drying cylinder as set forth in claim 1 wherein said turbulence producers are strips having equispaced transverse parts.

10. A drying cylinder as set forth in claim 9 wherein said strips are perforated bands.

11. A drying cylinder as set forth in claim 1 wherein said turbulence producers are made of wire and include at least one wire extending lengthwise of a respective groove and a plurality of wire pieces extending perpendicularly of said one wire to define said transverse parts.

12. A drying cylinder as set forth in claim 1 wherein said turbulence producers are made of wire pieces disposed in lattice-fashion, each said piece extending at an angle to the peripheral direction of a respective groove.

* * * * *

UNITED STATES PATENT AND TRADEMARK OFFICE

CERTIFICATE OF CORRECTION

PATENT NO. : 4,069,594

DATED : January 24, 1978

INVENTOR(S) : Guntram Feurstein

It is certified that error appears in the above-identified patent and that said Letters Patent are hereby corrected as shown below:

Column 4, line 5, change "embodided" to -- embodied --

Column 4, line 62, before "of" insert -- dimension --

Column 6, line 21 after "a" delete -- major --

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*